US009381562B2

(12) United States Patent
Tokura

(10) Patent No.: US 9,381,562 B2
(45) Date of Patent: Jul. 5, 2016

(54) TUBE EXPANSION DEVICE

(71) Applicant: KYOSHIN KOGYO CO., LTD., Osaka-shi, Osaka (JP)

(72) Inventor: Kenji Tokura, Osaka (JP)

(73) Assignee: KYOSHIN KOGYO CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 14/740,261

(22) Filed: Jun. 16, 2015

(65) Prior Publication Data

US 2015/0273562 A1 Oct. 1, 2015

Related U.S. Application Data

(63) Continuation of application No. PCT/JP2013/084774, filed on Dec. 18, 2013.

(30) Foreign Application Priority Data

Dec. 18, 2012 (JP) ..... 2012-289372

(51) Int. Cl.
*B21D 39/20* (2006.01)
*B21D 53/08* (2006.01)

(52) U.S. Cl.
CPC ..... *B21D 39/20* (2013.01); *B21D 53/085* (2013.01)

(58) Field of Classification Search
CPC ..... B21D 39/20; B21D 53/085; B21D 53/08; B21D 39/06; B21D 53/06; Y10T 29/49375; Y10T 29/53122
See application file for complete search history.

(56) References Cited

U.S. PATENT DOCUMENTS 3,677,053 A * 7/1972 Jewett ..... 72/111
4,584,751 A * 4/1986 Gray et al. ..... 29/727

(Continued)

FOREIGN PATENT DOCUMENTS

JP H01-023650 Y 7/1989
JP H05-084440 A 4/1993

(Continued)

OTHER PUBLICATIONS

International Search Report for PCT/JP2013/084774 dated May 20, 2014.

(Continued)

*Primary Examiner* — Alexander P Taousakis
*Assistant Examiner* — Mohammad I Yusuf
(74) *Attorney, Agent, or Firm* — Yokoi & Co., U.S.A.; Toshiyuki Yokoi

(57) ABSTRACT

The present invention provides a tube expansion device which can prevent decreases in productivity by causing only side regulating bodies to be moved easily and surely, even if the left and right ends of a heat exchanger increases or decreases, or the thickness of a heat exchanger is increased because an insertion tube becomes multiple columns from single column; and, in the case of tube expansion for a heat exchanger in long total length, and even if an expanding and a contracting rod of a cylinder which are reciprocating movement means of a reference platform or a rod-shaped male screw momentarily receives the weight of a stripper plate itself through said reference platform, can prevent deflection and breakage of said expanding and contracting rod and said rod-shaped male screw and breakage of cylinder's seal portion or breakage, etc. of a screw thread by supporting a reference platform at multiple points.

11 Claims, 6 Drawing Sheets

(56) References Cited

U.S. PATENT DOCUMENTS

| | | | | | |
|---|---|---|---|---|---|
| 4,780,955 | A | * | 11/1988 | Stroup | 29/727 |
| 4,850,101 | A | * | 7/1989 | McDonough et al. | 29/727 |
| 4,876,779 | A | * | 10/1989 | Gray | 29/727 |
| 5,003,691 | A | * | 4/1991 | Milliman et al. | 29/727 |
| 5,432,994 | A | * | 7/1995 | Tokura | 29/727 |
| 6,176,006 | B1 | * | 1/2001 | Milliman et al. | 29/727 |
| 7,448,127 | B2 | * | 11/2008 | Tokura | 29/727 |
| 8,037,595 | B2 | * | 10/2011 | Dees et al. | 29/727 |
| 8,087,159 | B2 | * | 1/2012 | Tokura | 29/727 |

FOREIGN PATENT DOCUMENTS

| | | | |
|---|---|---|---|
| JP | 2002-316227 | A | 10/2002 |
| JP | 2003-080330 | A | 3/2003 |

OTHER PUBLICATIONS

PCT written openion dated May 20, 2014.

* cited by examiner

PRIOR ART

TUBE EXPANSION DEVICE

CROSS-REFERENCES TO RELATED APPLICATIONS

This application claims the benefit of priority and is a Continuation application of the prior International Patent Application No. PCT/JP2013/084774, with an international filing date of Dec. 18, 2013, which designated the United States, and is related to the Japanese Patent Application No. 2012-289372, filed Dec. 18, 2012, the entire disclosures of all applications are expressly incorporated by reference in their entirety herein.

BACKGROUND OF THE INVENTION

1. Field of the Invention

The present invention relates to a tube expansion device which can manufacture a heat exchanger through integrating a multiply-polymerized integrating heat radiating fin and a plurality of tubes inserted to the heat radiating fins through pressing a tube expansion mandrel which expands the tube into a tube.

2. Description of Related Art

There exists this kind of tube expansion device published in a Japanese examined utility model application publication 1-23650 as an example as a prior art.

A tube expansion device published in the above publication forms a device main body 14*a* through a pair of posts 19*a* being founded with a predetermined distance on a base 19 as illustrated in FIG. 6 and through a top end of each post 19*a* being connected through a beam member 20.

A reciprocating effector 7 having said tube expansion mandrel 5 causes a guide bar (guide post) 21 founded oppositely to said posts 19*a* to be inserted and is provided in freely rising and falling (freely reciprocating) fashion through two cylinders 6 at a tube expansion device 14 forming a device main body 14*a* in accordance with the aforementioned constitution so that an end plate 15*a*, each of a plurality of heat radiating fins 15*b* and a tube 16 are integrated by pressing a tube expansion mandrel 5 into a tube opening of a tube 16 of a heat exchanger 15 set at a base 19.

An encoder 13 having a pinion gear 12 meshed with a rack 11 installed in a vertical state in order to measure a lowered distance of said reciprocating effector 7 moving toward a heat exchanger 15 and counting an turning angle of said pinion gear 12 is also provided at the reciprocating effector 7.

In addition, a force pressing plate 9 having a tube outer fitting body 9*a* to set a protrusion length of a tube 16 protruded from an end plate 15*a* by pushing down an end plate 15*a* in contact with said end plate 15*a* of a heat exchanger 15 is hung at said reciprocating effector 7.

A limit switch 10 detecting start of the lowering of a force pressing plate 9 which lowers to move toward a heat exchanger together 15 with a reciprocating effector 7 is provided at said force pressing plate 9.

Further, one balance cylinder 8 which operates to stop the lowering of a force pressing plate 9 when the lowering distance of a force pressing plate 7 measured by said encoder 13 reaches to a lowering distance set in advance and which measurement is conducted with a detecting signal of said limit switch 10 as a starting signal is provided at the both ends of said force pressing plate 9.

Thus, in a tube expansion device 14 constituted as stated above, a protrusion length of a tube 16 protruded from an end plate 15*a* of said heat exchanger 15 can be set at any time to a predetermined length by operation of said balance cylinder 8 to stop the lowering of a force pressing plate 9 when a measured value measured through said encoder 13 with detection signal of said limit switch 10 as a starting signal reaches to a predetermined value.

Manufacturing cost of a tube expansion device with the aforementioned constitution would, however, increase, since various equipment, etc. such as a limit switch 10, a rack 11 and an encoder 13 having a pinion gear to be engaged with said rack 11 shall be individually attached to a device, As a result, a tube expansion device having the constitution illustrated in FIG. 5 has been developed and gone on the market instead of said tube expansion device so as to prevent manufacturing cost increase as mentioned above.

Such a tube expansion device comprises a cylinder 4 equipped with a pulse encoder 18, and has a constitution that a reference platform 1 stopping lowering of a force pressing plate 9 is attached to an expanding and contracting rod 4*a* of said cylinder 4 through a fixing member 1*a* such as a male screw.

Accordingly, a tube expansion device having a constitution in the latter of the above does not need a process to operate a balance cylinder 8 after having measured the actual lowered distance of a lowering reciprocating effector 7 which are required for a tube expansion device 14 with a constitution in said above former, and can easily set a protrusion length of an expanding and contracting rod 4*a* through a pulse encoder 18 in advance.

Therefore, manufacturing cost can be suppressed by reducing a number of various equipment, such as a limit switch 10, a rack 11 and an encoder 13 having a pinion gear to be engaged with said rack 11.

Patent Literature 1: Examined Utility Model Application Publication No. 123650

BRIEF SUMMARY OF THE INVENTION

Though, a tube expansion device with the above constitution has problems as indicated below.

That is, while any of constitutions for the above former and the above latter provides that an end plate 15*a*, each of a plurality of heat radiating fins 15*b* and a tube 16 are integrated by pressing a tube expansion mandrel 5 into a tube opening of a tube 16 protruded from an end plate 15*a* of a heat exchanger 15, a heat exchanger 15 placed on a receiver 19*b* (a receiving body of various tubes 16 such as a hairpin tube, a straight tube, etc. inserted into a heat exchanger 15) of a base 19 is very unstable and is in a condition that the entire shape cannot be maintained before a tube expansion mandrel 5 is pushed into since a plurality of tubes 16 are just inserted into each of a plurality of heat radiating fins.

Thus, while a method to stabilize the entire shape of a heat exchanger 15 prior to or at the time of indentation of a tube expansion mandrel 5 has been taken wherein usually the back surface of a heat exchanger 15 placed on a receiver 19*b* is received by a rear surface regulating body 25 provided at a tabular receiving body 24 installed on a base 19, and left and right ends of said heat exchanger 15 (width end of a heat exchanger 15 insertion column-wise of an insertion tube 16) becomes nipping and holding condition through a left-and-right pair of side regulating bodies screwed and fixed to a rear surface regulating body, recently, a heat exchanger 15 diversifies wherein there are cases that left and right ends of a heat exchanger 15, namely the width of a heat exchanger 15 increases or decreases or the thickness of a heat exchanger is increased because an insertion tube 16 becomes in multiple columns from single column as an example, and in the past, type of a side regulating body 26 of a rear surface regulating body 25 or a screw fixing point (in order to correspond to width end, namely left and right ends) is changed in each case corresponding to the kind of a heat exchanger 15 for which tube expansion is conducted.

The problems such as work and adjustment therefor being complicated and the work time directly affecting to the manufacturing have occurred accordingly.

Additionally, any of the above former and the above latter constitutions provides that a force pressing plate 9 stops at a predetermined point through only a pair of cylinders supporting the both ends of said force pressing plate 9.

Thus, when stopping the lowering of a force pressing plate 9 along with a reciprocating effector 7 at a predetermined location during tube expansion, only an expanding and contracting rod of a cylinder always receives the weight of a force pressing plate 9 itself through a reference platform 1 provided at said expanding and contracting rod.

Therefore, if an expanding and contracting rod of a cylinder only receives the weight of a force pressing plate 9 itself and if an extended length of an expanding and contracting rod exceeds a certain length, instantaneous deflection is generated at said expanding and contracting rod, and the degree of such deflection increases in proportion to the extended length of an expanding and contracting rod.

Consequently, when conducting tube expansion for a heat exchanger 15 with especially long total length set at a receiver 19*b* of a base 19 of a device main body 14*a*, an expanding and contracting rod is extended from a cylinder with approximately maximum length, and as a result there was a threat that a seal portion of a cylinder is broken due to large deflection of an expanding and contracting rod at the moment that an expanding and contracting rod in extended condition with approximately maximum length from a cylinder receives the weight of a force pressing plate 9 itself.

Moreover, in case of conducting tube expansion for a heat exchanger 15 with long total length as mentioned above, extension length of an expanding and contracting rod is naturally limited, and thereby in case of conducting tube expansion for a heat exchanger 15 with especially long total length (an insertion tube becoming longer too), a cylinder must be changed to a cylinder with an expanding and contracting rod having a suitable effective stroke and the change work therefor is complicated and there was a cost issue that a cylinder corresponding to the total length of a heat exchanger should be prepared.

Even if said reference platform 1 is reciprocated using a reciprocating movement method through a rod-shaped male screw (driven by a motor, etc.) installed on a base 19 instead of said cylinder, there was also a threat that a rod-shaped male screw is deflected to a great degree as mentioned above and a screw thread is broken when a reference platform 1 receives the weight of a force pressing plate 9 itself.

The present invention provides a tube expansion device which can prevent the reduction of productivity by easily and surely moving only side regulating bodies even if the left and right ends of a heat exchanger, namely, the width of a heat exchanger, increases or decreases, or even if the thickness of the heat exchanger increases caused by insertion tubes being increased from a single column to multiple columns; and can prevent deflection and breakage of said expanding and contracting rod and said rod-shaped male screw and breakage of cylinder's seal portion or breakage, etc. of a screw thread by supporting a reference platform at multiple points, even if the width of a heat exchanger increases or decreases or the thickness of a heat exchanger increases or decreases, or even if tube expansion is conducted for a heat exchanger in long total length (tall), or even if an expanding and contracting rod of a cylinder, which is a reciprocating movement means of a reference platform, or a rod-shaped male screw momentarily receives a the weight of a force pressing plate itself through the reference platform.

That is, the present invention is developed to solve the above problems, and comprises a reference platform 1 to stop a force pressing plate 9 at predetermined position wherein the force pressing plate freely reciprocate along the longitudinal direction of posts 19*a* provided on said base 19 of a tube expansion device 14 sets protrusion length of a tube 16 protruded from an end plate 15*a* by pushing down said end plate 15*a* of a heat exchanger 15 set at the base 19, and has a constitution that, in a tube expansion device 14 with side regulating bodies 26 positioning said heat exchanger 15 at a tube expansion position in nipping and holding condition, the side regulating body 26 is provided in freely attachable and detachable fashion through magnets 28 at least at either of a rear surface regulating body 25 of a heat exchanger 15 provided at a tube expansion device 14 or a receiving body 24 in which said rear surface regulating body 25 is provided.

Additionally, the present invention has a constitution that a stackable side regulating body g 27 is freely attached to or detached from a side regulating body 26 using magnets 28*a* through a positioning means.

Therefore, the present invention has an advantage to conduct tube expansion process without reducing productivity wherein even if the left and right ends of a heat exchanger, namely the width of a heat exchanger increases or decreases, a heat exchanger is held in nipping and holding condition by easily and surely moving a side regulating body only provided at either of a rear surface regulating body 25 or a receiving body 24 having said rear surface regulating body, and has an advantage to prevent reduction of productivity wherein even if the thickness of a heat exchanger is increased because an insertion tube becomes in multiple columns from single column, the thickness of a side regulating body can be changed immediately through easily and surely attaching and detaching a stackable side regulating body to or from a side regulating body corresponding to the thickness of a heat exchanger.

The present invention provides that said reference platform 1 is supported at multiple points of posts 19*a* and an expanding and contracting rod or multiple points of posts 19*a* and a rod-shaped male screw, and provided in a fashion of freely reciprocating along the longitudinal direction of posts 19*a* through the rear surface regulating body 25 being provided between posts 19*a*, one side of said reference platform 1 being provided at said posts 19*a* in a freely slidable fashion and the other side being provided at an expanding and contracting rod or a rod-shaped male screw.

The present invention provides that a guide hole portion 1*c* in which a guide bar 21 provided parallel to said posts 19*a* is inserted is provided at a portion of a reference platform 1, and thereby said reference platform 1 is supported at multiple points of posts 19*a*, an expanding and contracting rod and a guide bar 21 or at multiple points of posts 19*a*, a rod-shaped male screw and a guide bar 21 in a fashion of freely reciprocating along the longitudinal direction of posts 19*a*.

The present invention provides that an expanding and contracting rod or a rod-shaped male screw is located between a post 19*a* and guide bar 21.

Thus, the present invention has an advantage that even if a reference platform 1 momentarily receives the weight of a force pressing plate 9 itself in case of conducting tube expansion for a heat exchanger 15 with especially long total length, deflection of an expanding and contracting rod of a cylinder and deflection of a rod-shaped male screw can be reduced by supporting said reference platform 1 at multiple points of a post 19*a* and an expanding and contracting rod or at multiple points of a post 19*a* and a rod-shaped male screw in axially and freely positionable fashion.

Further, the present invention provides an advantage that in the event that a part of a reference platform 1 is supported by posts 19*a* and guide bars 21 founded parallel to an expanding and contracting rod in axially and freely positionable fashion or supported by posts 19*a* and guide bars 21 parallel to a rod-shaped male screw in axially and freely positionable fashion causing a reference platform 1 to be provided in freely movable fashion through the both of a post 19*a* and a guide bar 21, occurrence of breakage or deflection of an expanding and contracting rod and a rod-shaped male screw can be strongly prevented due to a reference platform being strongly supported at multiple points even if a reference platform momentarily receives the weight of a force pressing plate 9 itself.

The present invention also has an advantage to conduct tube expansion process without reducing productivity through easily and surely attaching and detaching a stackable side regulating body to or from a side regulating body wherein in a tube expansion device 14 with a side regulating body positioning a heat exchanger 15 at a tube expansion position in nipping and holding condition, said side regulating body 26 is provided at a predetermined point of a tube expansion device main body 14*a* through magnets 28 in freely attachable and detachable fashion, even if the left and right ends of a heat exchanger, namely the width of a heat exchanger increases or decreases.

Additionally, the present invention has an advantage to prevent reduction of productivity wherein, since a stackable side regulating body 27 is provided through positioning means at said side regulating body 26 in freely attachable and detachable fashion via magnets 28, even if the thickness of a heat exchanger is increased because an insertion tube becomes in multiple columns from single column, the thickness of a side regulating body can be changed immediately corresponding to the thickness of a heat exchanger through easily and surely attaching and detaching a stackable side regulating body to or from a side regulating body.

As stated above, the present invention has an effect to conduct tube expansion process without reducing productivity, comprising a reference platform 1 to stop a force pressing plate 9 at predetermined position wherein the force pressing plate freely reciprocates along the longitudinal direction of posts 19*a* provided on a base 19 of a tube expansion device 14 sets protrusion length of a tube 16 protruded from said end plate 15*a* by pushing down an end plate 15*a* of said heat exchanger 15 set at said base 19; and having a constitution that, in a tube expansion device 14 with side regulating bodies 26 positioning the heat exchanger 15 in nipping and holding condition at a tube expansion position, since said side regulating body 26 is provided in freely attachable and detachable fashion through magnets 28 at least at either of a rear surface regulating body 25 of a heat exchanger 15 provided at a tube expansion device 14 or a receiving body 24 in which said rear surface regulating body 25 is provided, said side regulating body 26 is provided in freely attachable and detachable fashion through magnets 28 at least at either of a rear surface regulating body 25 of a heat exchanger 15 provided at a tube expansion device 14 or a receiving body 24 in which the rear surface regulating body 25 is provided, even if the left and right ends of a heat exchanger, namely the width of a heat exchanger increases or decreases.

Furthermore, the present invention has an advantage to prevent reduction of productivity wherein since a stackable side regulating body 27 is provided through positioning means at a side regulating body 26 in freely attachable and detachable fashion via magnets 28, even if the thickness of a heat exchanger is increased because an insertion tube becomes in multiple columns from single column, the thickness of a side regulating body can be changed immediately corresponding to the thickness of a heat exchanger through easily and surely attaching and detaching a stackable side regulating body to or from a side regulating body.

In addition, the present invention provides an advantage that since a rear surface regulating body 25 is provided between posts 19*a* and one side of said reference platform 1 is provided at said posts 19*a* in freely slidable fashion, and the other side is provided at an expanding and contracting rod or a rod-shaped male screw, and thereby said reference platform 1 is supported by multiple points of posts 19*a* and an expanding and contracting rod or multiple points of posts 19*a* and a rod-shaped male screw and provided along with a longitudinal direction of a post 19*a* in freely reciprocating fashion, deflection of an expanding and contracting rod of a cylinder and breakage of seal portion of a cylinder can be prevented because a reference platform 1 is supported at multiple points of posts 19*a* and an expanding and contracting rod or at multiple points of posts 19*a* and a rod-shaped male screw in axially and freely positionable fashion, even if a reference platform 1 momentarily receives the weight of a force pressing plate 9 itself, breakage of engagement portion of a reference platform and a female screw portion as well as screw thread of a rod-shaped make screw can be prevented through said female screw portion being provided at said reference platform in the condition that a rod-shaped male screw is screwed and inserted in to said female screw portion in the case of conducting tube expansion for a heat exchanger with long total length, and in the case of using a rod-shaped male screw.

Thus, the present invention provides an effect that even if a reference platform 1 momentarily receives the weight of a force pressing plate 9 itself in case of conducting tube expansion for a heat exchanger 15 with especially long total length, deflection of an expanding and contracting rod of a cylinder and deflection of a rod-shaped male screw can be reduced by supporting a reference platform at multiple points since said reference platform 1 is supported at multiple points of posts 19*a* and an expanding and contracting rod or posts 19*a* and a rod-shaped male screw in axially and freely positionable fashion.

Furthermore, the present invention provides an advantage that in the case of a female portion parallel to a posts being provided at a reference platform as mentioned above and a rod-shaped male screw being screwed and inserted into said female portion in freely rotatable fashion, and even if the total length of a heat exchanger in which tube expansion is conducted is different, it is not necessary to prepare or change a tube expansion device corresponding to the total length of a heat exchanger and a reference platform can move (ascent and descent) extensively by rotation of a rod-shaped male screw corresponding to the total length of a heat exchanger, which brings an effect that an extremely high versatile heat exchanger can be provided.

The present invention also provides an effect that since a guide hole portion 1*c* in which a guide bar 21 provided parallel to the posts 19*a* is inserted is provided at a portion of the reference platform 1, and thereby said reference platform 1 is supported at multiple points of posts 19*a*, an expanding and contracting rod and a guide bar 21 or at multiple points of posts 19*a*, a rod-shaped male screw and a guide bar 21 in the fashion of freely reciprocating along the longitudinal direction of a post 19*a*, a reference platform is provided in freely movable fashion through the both of posts 19*a* and a guide bar 21, and thereby occurrence of breakage or deflection of an expanding and contracting rod and a rod-shaped male screw can be strongly prevented due to a reference platform being strongly supported at multiple points even if a reference platform momentarily receives the weight of a force pressing plate 9 itself.

Additionally, the present invention provides an effect that since an expanding and contracting rod or a rod-shaped male screw is located between a post 19*a* and guide bar 21 even if a reference platform 1 momentarily receives the weight of a force pressing plate 9 itself in case of conducting tube expansion for a heat exchanger 15 with especially long total length, deflection of an expanding and contracting rod of a cylinder and deflection of a rod-shaped male screw can be more surely reduced by supporting a reference platform at the both ends of multiple points with good balance.

The present invention also provides an effect to conduct tube expansion process without reducing productivity wherein in a tube expansion device 14 with a side regulating body positioning a heat exchanger 15 at a tube expansion position in nipping and holding condition, since said side regulating body 26 is provided at a predetermined point of a tube expansion device main body 14*a* through magnets 28, even if the left and right ends of a heat exchanger, namely the width of a heat exchanger increases or decreases in this case, a heat exchanger can be held in nipping and holding condition by easily and surely moving a side regulating body only.

Moreover, the present invention has an effect to prevent reduction of productivity wherein since a stackable side regulating body is provided through positioning means at said side regulating body 26 in freely attachable and detachable fashion via magnets 28, even if the thickness of a heat exchanger is increased because an insertion tube becomes in multiple columns from single column, the thickness of a side regulating body can be changed immediately corresponding to the thickness of a heat exchanger through easily and surely attaching and detaching a stackable side regulating body to or from a side regulating body.

BRIEF DESCRIPTION OF THE DRAWINGS

FIG. 1A is a partially omitted plan view, FIG. 1B is a partially omitted front view, and FIG. 1C and FIG. 1D are right-side views.

FIG. 2A is a partially omitted plan view, FIG. 2B is a partially omitted front view, and FIG. 2C and FIG. 2D are right-side views.

FIG. 3A is a partially omitted perspective view and FIG. 3B is a main section explanatory drawing.

DETAILED DESCRIPTION OF THE INVENTION

Figure 1A:
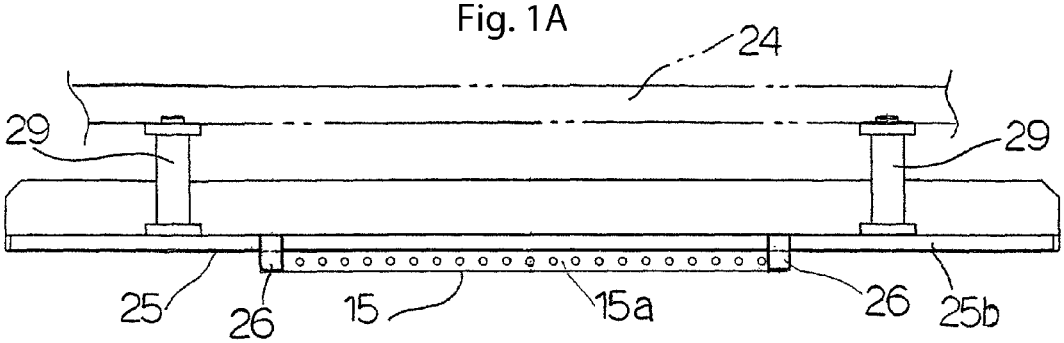
FIGS. 1A, 1B, 1C and 1D illustrate a receiving body and a side regulating body of a tube expansion device of the present invention.
Figure 1B:
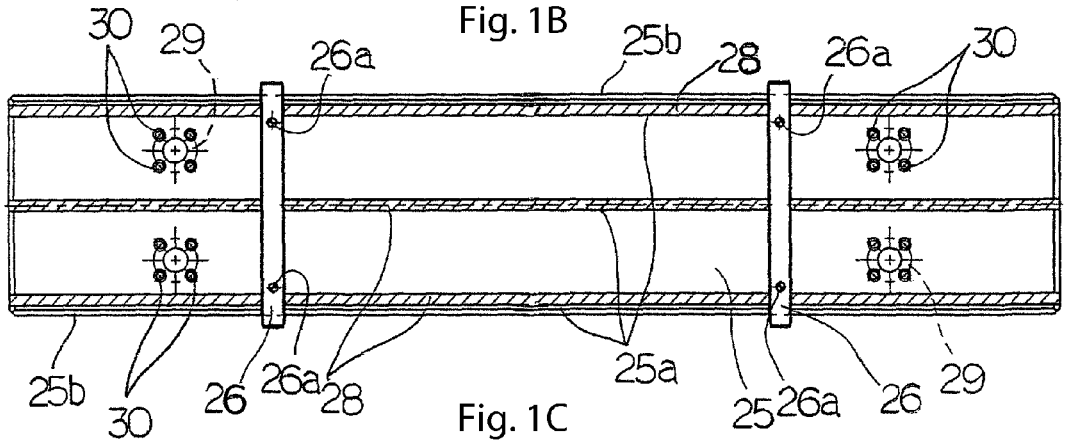
Figure 1C:
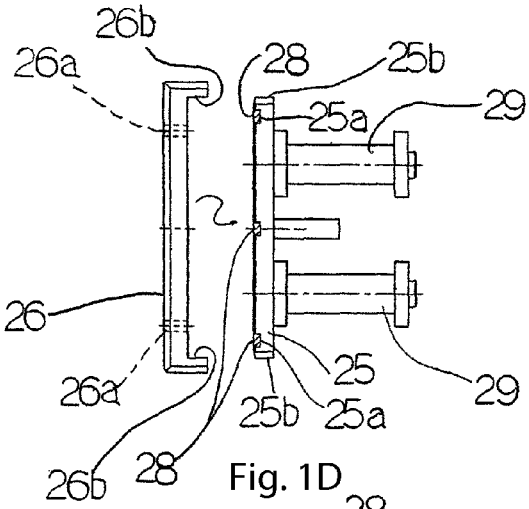
Figure 1D:
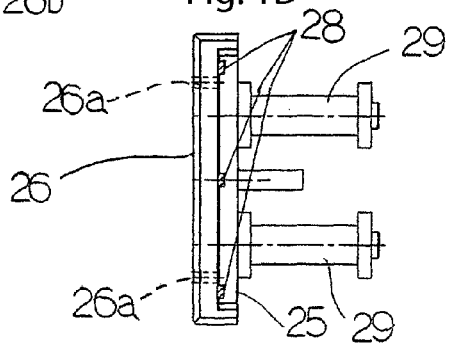
Figure 2A:
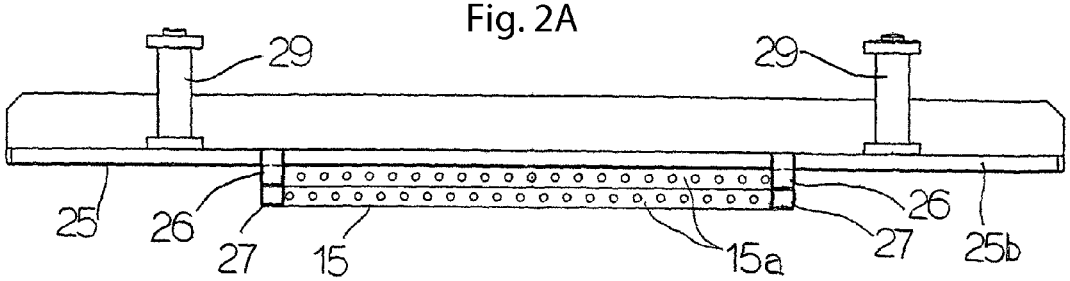
FIGS. 2A, 2B, 2C and 2D illustrate the other embodiments of a receiving body and a side regulating body of a tube expansion device of the present invention.
Figure 2B:
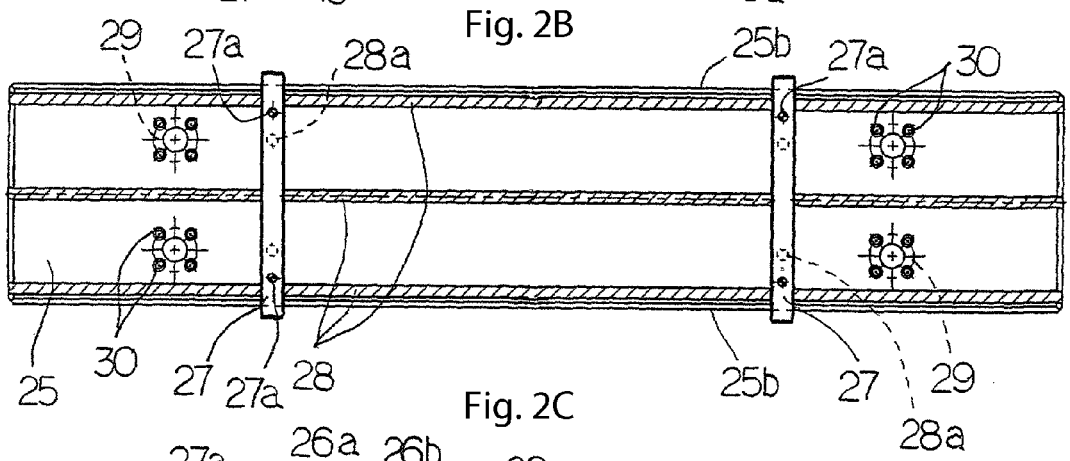
Figure 2C:
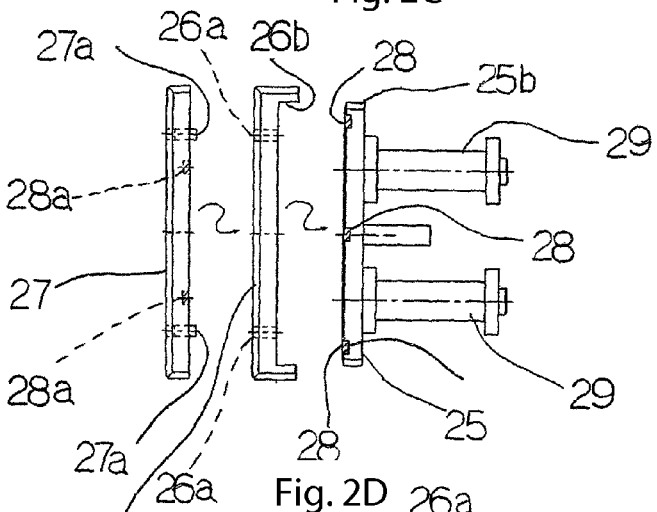
Figure 2D:
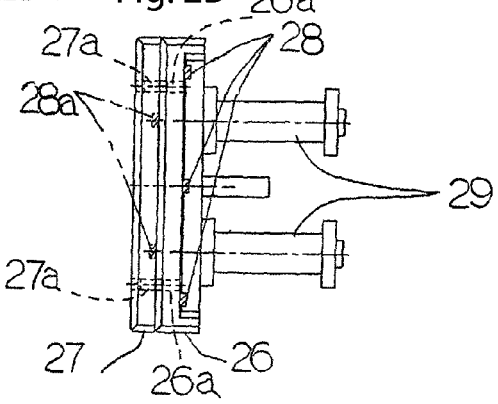
Figure 3B:
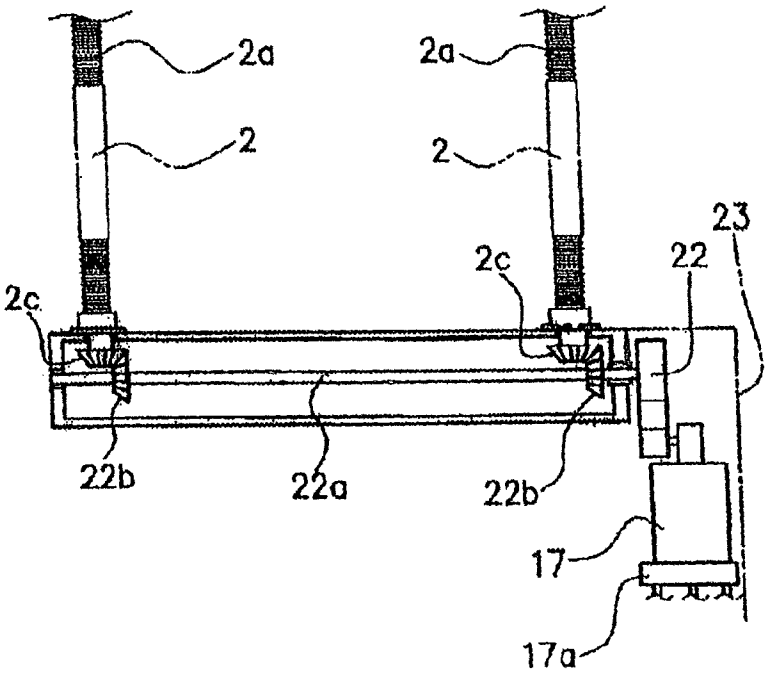
FIGS. 3A and 3B illustrate the vicinity of a reference platform of a tube expansion device of the present invention.
Figure 3A:
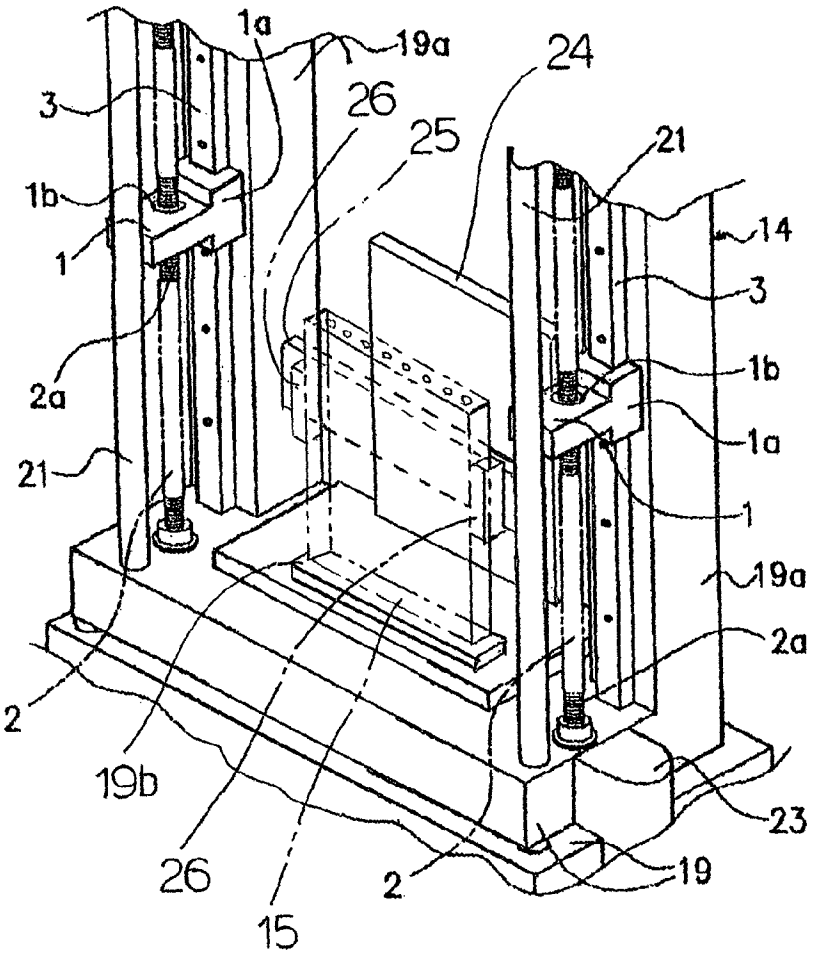

One embodiment of this present invention is explained below based on figures and explanations of the portions overlapped with a conventional tube expansion device will be omitted.

In FIG. 1A through FIG. 3B, 1 indicates a reference platform and, at one side of such a reference platform 1, a slide retaining body 1*a* fitting onto LM guide 3 each attached to a post 19*a* provided at a base 19 in freely slidable fashion is provided, and, at the other side, a female screw 1*b* in which a rod-shaped male screw (guiding rod) 2 parallel to said post 19*a* and founded on a base 19 with a male screw 2*a* formed thereon is screwed and inserted is provided in freely rotating fashion.

A motor 17 with a pulse encoder 17*a* is housed in the side portion 23 of said base 19, a gear 22*b* attached to a rotating rod 22*a* which is rotated by a belt body 22 rotating through said motor 17 is provided inside said base 19, and a gear 2*c* firmly fixed to a lower end of a rod-shaped male screw 2 founded on said base 19 is engaged with said gear 22*b*.

24 indicates a tabular receiving body placed on said base 19 of which location is between said posts 19*a*, and a rear surface regulating body 25 for receiving a back side of a heat exchanger 15 placed on a receiver 19*b* of said base 19 through a pair of cylindrical stays 29 provided with a predetermined distance is firmly fixed to the receiving body 24 through a mounting bolt 30.

Said rear surface regulating body 25 is formed by an elongate plate in a rectangular shape of which length in width direction is longer than the left and right sides of a heat exchanger 15 (width of a heat exchanger 15 insertion column-wise of an insertion tube) placed on a receiver 19*b*, namely the length in the width direction is longer than the length in the longitudinal direction of insertion tube of a heat exchanger that is vertical direction length of a heat exchanger, and 3 columns of grooves 25*a* are provided on said rear surface regulating body 25 in predetermined distance along the longitudinal direction of an elongate plate, and magnets 28 are embedded in said each groove 25*a* along the longitudinal direction of an elongate plate.

In the event that magnets 28 are embedded in the grooves 25*a* mentioned above, a receiving surface of a rear surface regulating body 25 to receive a backside of a heat exchanger 15 is formed to have flush surface so that magnets 28 do not protrude.

26 is freely attached to and detached from a rear surface regulating body 25, indicates left-and-right pair of a side regulating bodies to make a heat exchanger nipping and holding condition at the left and right ends of a heat exchanger 15 placed on a receiver 19*b* (width end of a heat exchanger 15 insertion column-wise of an insertion tube), that is, in the width direction, and is formed in almost the shape of concave if viewed from side; and a locking portion 26*b* allowing said side regulating body to be locked to both edges portion of said rear surface regulating body 25 in the longitudinal direction is provided, and is formed by a metal body allowed to attach to said magnets 28.

Thus, in case of using a side regulating body 26 in such constitution, a heat exchanger 15 is received and retained by a rear surface regulating body 25 through making left and right ends of a heat exchanger (width end of a heat exchanger 15 insertion column-wise of an insertion tube) 15 for which a tube expansion is conducted, that is, the width direction of a heat exchanger 15 nipping and holding condition with a pair of side regulating bodies 26.

Additionally, even if the left and right ends of a heat exchanger, namely the width of a heat exchanger increases or decreases, a heat exchanger can be held in nipping and holding condition by easily and surely moving side regulating bodies 26 only from a rear surface regulating body 25 since side regulating bodies 26 are provided in freely attachable and detachable fashion to a rear surface regulating body 25 of a heat exchanger 15 provided at a tube expansion device 14, which brings an effect to conduct a tube expansion process without reducing productivity.

In FIGS. 1A-1D and FIGS. 2A-2D, a positioning concave portion 26*a* (for instance, at 2 points with a predetermined distance) of a stackable side regulating body 27 mentioned below may be provided at a back surface portion of a side regulating body 26 locked at a rear surface regulating body 25 as stated above.

That is, such a stackable side regulating body 27 is used to increase the thickness (height) of a side regulating body 26 by being piled up onto a side regulating body in the event that a heat exchanger's thickness is increased through an insertion tube becomes in multiple columns from a single column, for example.

Further in more details, a positioning convex portion 27*a* fitting in a positioning concave portion 26*a* in freely attachable and detachable fashion which is provided at the back surface portion of said side regulating body 26 is provided at a stackable side regulating body 27, and magnets 28*a* allowing said stackable side regulating body to be attached to and detached from the back surface portion of a side regulating body are embedded in the vicinity of said positioning convex portion 27*a*.

Such a stackable side regulating body 27 having a constitution as stated above causes the thickness of a side regulating body to be changed immediately corresponding to the thickness of a heat exchanger through easily and surely attaching and detaching a stackable side regulating body to or from a side regulating body, even if the thickness of a heat exchanger is increased because an insertion tube becomes in multiple columns from single column, which brings an effect to prevent the reduction of productivity.

While a side regulating body 26 has a constitution of being freely attached to and detached from a rear surface regulating body 25 through magnets 28 provided on said rear surface regulating body 25 in the above embodiments, it is not necessary for magnets to be provided on a rear surface regulating body 25, a rear surface regulating body 25 may consist of a part or a whole of a metal body attracted to magnets, a side regulating body may equip magnets, or magnets may be provided on each of a side regulating body 26 and a rear surface regulating body 25, and it goes without saying that specific location, fixing structure, numbers, etc. of magnets are not limited.

Further, while a side regulating body 26 is provided to be freely attached to and detached from a rear surface regulating body 25 through magnets in the embodiments stated above, it is not limited to a rear surface regulating body 25, a side regulating body 26 may be provided to be freely attached to and detached from a receiving body 24 with a rear surface regulating body 25 through magnets for example, further said side regulating body 26 may be provided to mount on both of a receiving body 24 and a rear surface regulating body 25 in freely attachable and detachable fashion, in this case, installation point of a side regulating body 26 causes to be changed immediately corresponding to changes in width or thickness of a heat exchanger for which tube expansion is conducted while shape, size, etc. of a side regulating body becomes a little complicated, which has its original effect to prevent the reduction of productivity.

While magnets 28*a* are provided at a stackable side regulating body 27 to allow attaching and detaching said stackable side regulating body 27 to and from a back surface portion of a side regulating body 26, magnets may be provided on the back surface portion of a side regulating body 26 for example and said stackable side regulating body 27 is partially or wholly formed by a metal body capable of being attached to or detached from said magnets, further said magnets may be provided at each of a stackable side regulating body 27 and a side regulating body 26, and location, numbers, etc. of said magnets are not limited.

In short, if a tube expansion device 14 with a side regulating body 26 that positions a heat exchanger 15 at a tube expansion location in nipping and holding condition has a constitution that said side regulating body 26 is freely attached to or detached from a predetermined point of a tube expansion device main body 14*a* through magnets 28, specific shape, size, numbers of a stackable side regulating body 27 as well as a side regulating body 26, location of magnets, or attaching and detaching point, etc. to a heat exchanger main body are absolutely not limited and it goes without saying that design change is freely conducted within the present invention's scope.

Additionally, in the embodiments stated above, a tube expansion device can stop a reference platform 1 at any position through rotations of a motor 17, a pulse encoder 17*a* and a rod-shaped male screw 2 corresponding to the total length of a heat exchanger for which tube expansion is conducted.

Thus, even if a reference platform 1 momentarily receives the weight of a force pressing plate 9 itself at tube expansion, deflection of a rod-shaped male screw 2 can be reduced since a reference platform 1 is provided at a pole 19*a* in freely sliding fashion, which brings an advantage that breakage of engagement portion of a reference platform and a female screw portion 1*b* as well as screw thread of a rod-shaped male screw 2 is prevented.

Furthermore, since a female screw portion 1*b* in which a rod-shaped male screw 2 parallel to a post 19*a* is screwed and inserted in freely rotating fashion is provided at a reference platform 1 in the embodiments stated above, it is not necessary to prepare or change a cylinder corresponding to the total length of a heat exchanger even if the total length of a heat exchanger 15 for which tube expansion is conducted varies, which brings an advantage that a reference platform 1 causes to be moved extensively by rotation of a rod-shaped male screw 2 corresponding to the total length of a heat exchanger 15.

Figure 4:
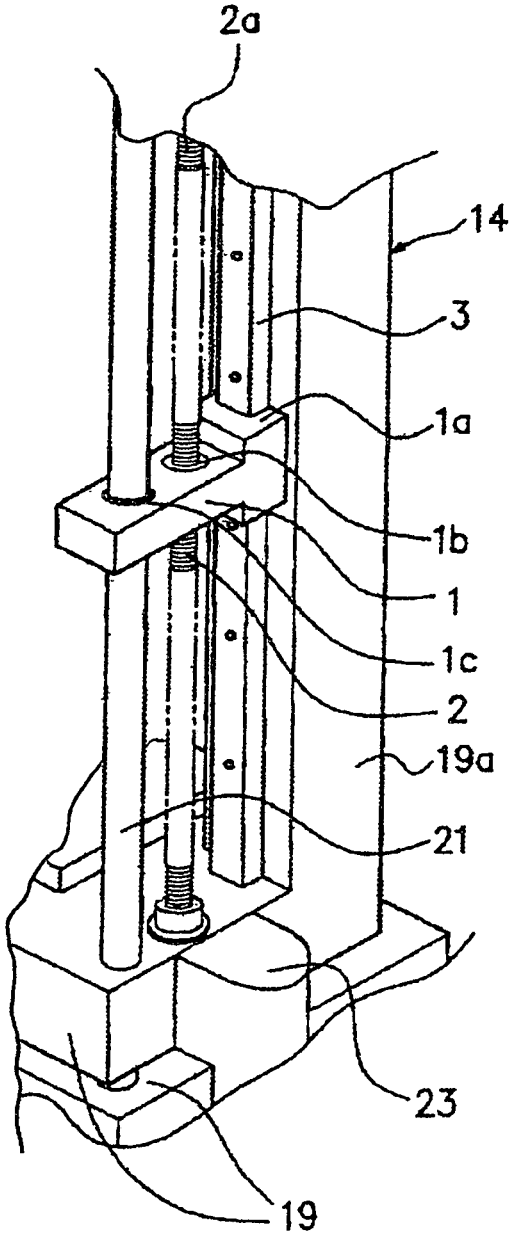
FIG. 4 is a partially omitted perspective view of the vicinity of a reference platform of a tube expansion device in the other embodiments.
Figure 5:
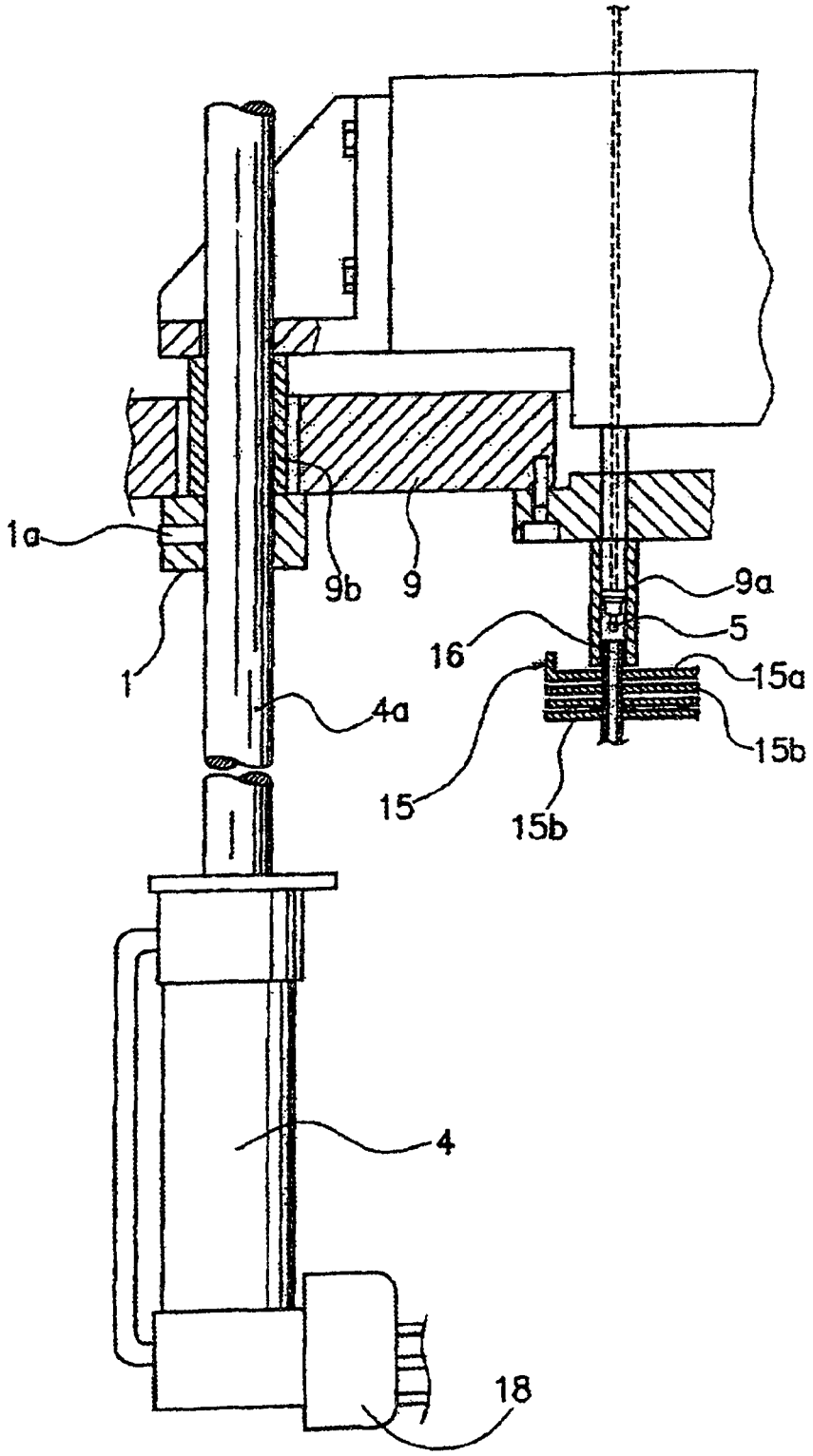
FIG. 5 is a partial cross-sectional view with a main section of a conventional tube expansion device enlarged.
Figure 6:
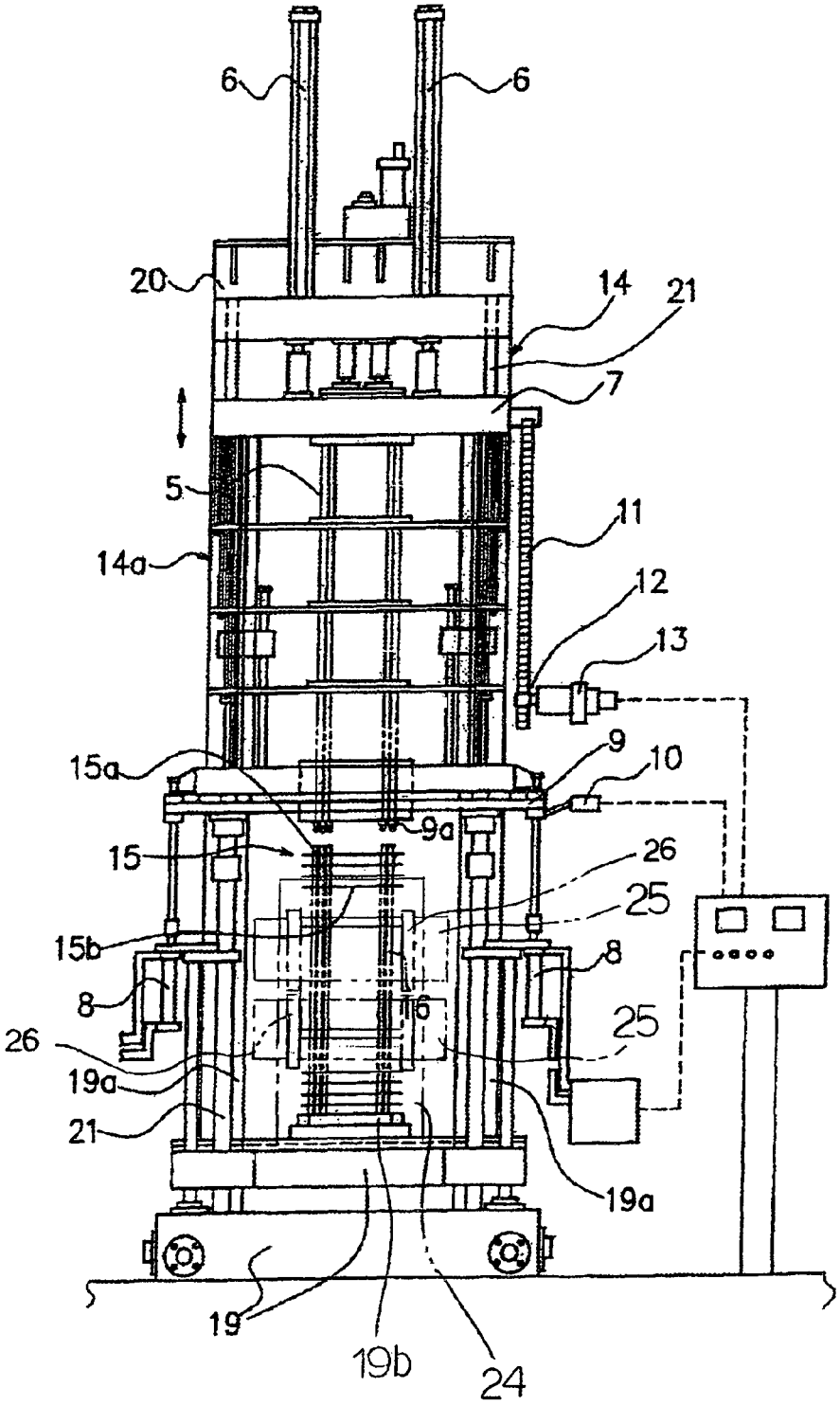
FIG. 6 is a front view of a conventional tube expansion device.

In addition, as illustrated in FIG. 4, one portion of a reference platform 1 (the other end portion) may be provided in freely movable fashion at a guide bar (a guide post of a reciprocating effector) 21 provided in parallel to said post 19*a* through a guide hole 1*c*.

Accordingly, the present invention provides an advantage that, even if a reference platform 1 momentarily receives the weight of a force pressing plate 9 itself, deflection of a rod-shaped male screw is strongly prevented and breakage of screw thread of a rod-shaped male screw and engagement portion of a reference platform 1 and a female screw portion 1*b* can be prevented by providing a reference platform 1 at the both of a post 19*a* and a guide bar 21 in freely movable fashion through a guide hole 1*c* and a slide retaining body 1*a*.

Furthermore, while a reference platform 1 is provided at a rotatable rod-shaped male screw (a guiding rod) 2 in freely movable fashion through a female screw portion 1*b* in the above embodiment, it is not limited to a rod-shaped male screw 2, and a reference platform 1 may be provided at an expanding and contracting rod (not pictured) of a cylinder and a reference platform 1 may be provided at a post 19*a* in freely slidable fashion.

Thus, the present invention has an advantage that, in the case of a reference platform being provided at an expanding and contracting rod (not pictured), even if said reference platform 1 momentarily receives the weight of a force pressing plate 9 itself, since a reference platform 1 is provided at a pole 19*a* in freely slidable fashion, deflection of an expanding and contracting rod of a cylinder can be reduced and breakage of a seal portion of a cylinder caused by an expanding and contracting rod's deflection is prevented.

Further, the present invention has an advantage that, in the event that, as aforementioned, a reference platform 1 is provided at an expanding and contracting rod and at a post 19*a* in freely slidable fashion, and a part of a reference platform is provided at a guide bar 21 parallel to said post 19*a* in freely movable fashion, deflection of an expanding and contracting rod can be strongly prevented.

In addition, while one side of a reference platform 1 is fitted in freely slidable fashion onto a LM guide 3 attached to each post 19*a* provided at a base 19 in the above embodiment, it goes without saying that, in short, it is not limited to a LM guide if the constitution is such that a reference platform 1 is provided at said post 19*a* in freely slidable fashion.

Further, while a tube expansion device is a so-called vertical type tube expansion device in the above embodiment, it may be a horizontal type tube expansion device, and, in a tube expansion devise wherein a reference platform in contact with said force pressing plate is provided in a fashion freely reciprocating along with posts so as to stop a force pressing plate equipped with a tube expansion device at a predetermined position, any constitution such that said reference platform is provided at said posts in freely slidable fashion is allowed.

That is, the present invention has an effect to conduct tube expansion process without reducing productivity wherein, even if the left and right ends of a heat exchanger, namely the width of a heat exchanger 15 increases or decreases, since a side regulating body 26 is provided to freely attach to and detach from at least either of a rear surface regulating body 25 of a heat exchanger 15 or a receiving body 24 in which said rear surface regulating body is provided through magnets 28, even if the left and right ends of a heat exchanger, namely the width of a heat exchanger increases or decreases, a heat exchanger 15 can be held in nipping and holding condition by easily and surely moving a side regulating body 26 only provided at either of a rear surface regulating body 25 or a receiving body 24 in which said rear surface regulating body 25 is provided, which brings an effect to conduct a tube expansion process.

Additionally, the present invention provides an effect to prevent reduction of productivity wherein since a stackable side regulating body 27 is provided through positioning means at a side regulating body 26 in freely attachable and detachable fashion via magnets 28, even if the thickness of a heat exchanger is increased because an insertion tube becomes in multiple columns from single column, the thickness of a side regulating body can be changed immediately corresponding to the thickness of a heat exchanger through easily and surely attaching and detaching a stackable side regulating body to or from a side regulating body.

In addition, the present invention provides an advantage that since a rear surface regulating body 25 is provided between posts 19*a*, and one side of said reference platform 1 is provided at said posts 19*a* in freely slidable fashion, and the other side is provided at an expanding and contracting rod or a rod-shaped male screw, and thereby said reference platform 1 is supported by multiple points of posts 19*a* and an expanding and contracting rod or multiple points of posts 19*a* and a rod-shaped male screw, and provided along with a longitudinal direction of a post 19*a* in freely reciprocating fashion, even if a reference platform 1 momentarily receives the weight of a force pressing plate 9 itself in the case of conducting tube expansion for a heat exchanger with long total length, deflection of an expanding and contracting rod of a cylinder and breakage of seal portion of a cylinder can be prevented because a reference platform 1 is supported at multiple points of posts 19*a* and an expanding and contracting rod or at multiple points of posts 19*a* and a rod-shaped male screw in axially and freely positionable fashion, and in the case of using a rod-shaped male screw, a female screw portion is provided at said reference platform, in the condition that a rod-shaped male screw is screwed and inserted in to said female screw portion, breakage of engagement portion of a reference platform and said female screw portion as well as screw thread of a rod-shaped make screw can be prevented.

Thus, the present invention provides an effect that, even if a reference platform 1 momentarily receives the weight of a force pressing plate 9 itself in conducting tube expansion for a heat exchanger 15 with especially long total length, since a reference platform is supported at multiple points of a post 19*a* and an expanding and contracting rod or a post 19*a* and a rod-shaped male screw to freely change axial positions, deflection of an expanding and contracting rod of a cylinder and deflection of a rod-shaped male screw can be reduced by supporting said reference platform 1 at multiple positions.

Furthermore, the present invention provides an effect that, in the case that a female screw portion is provided at a reference platform and a rod-shaped male screw parallel to a post is screwed and inserted into said female screw portion in rotatable fashion as mentioned above, even if the total length of a heat exchanger in which tube expansion is conducted, it is not necessary to prepare or change to a tube expansion device corresponding to the total length of a heat exchanger and a reference platform can move (ascent and descent) extensively by rotation of a rod-shaped male screw corresponding to the total length of a heat exchanger, which brings an effect that an extremely high versatile heat exchanger can be provided.

The present invention also provides an effect that, since a guide hole portion 1*c* in which a guide bar 21 provided parallel to said posts 19*a* is inserted is provided at a portion of said reference platform 1, and thereby a reference platform 1 is supported at multiple points of posts 19*a*, an expanding and contracting rod and a guide bar 21 or at multiple points of posts 19*a*, a rod-shaped male screw and a guide bar 21 in the fashion of freely reciprocating along the longitudinal direction of a post 19*a*, a reference platform is provided in freely movable fashion through the both of posts 19*a* and a guide bar 21, which brings an effect that occurrence of breakage or deflection of an expanding and contracting rod and a rod-shaped male screw can be strongly prevented due to a reference platform being strongly supported at multiple points even if a reference platform momentarily receives the weight of a force pressing plate 9 itself.

Additionally, the present invention provides an effect that, since an expanding and contracting rod or a rod-shaped male screw is located between a post 19*a* and guide bar 21 even if a reference platform 1 momentarily receives the weight of a force pressing plate 9 itself in case of conducting tube expansion for a heat exchanger 15 with especially long total length, deflection of an expanding and contracting rod of a cylinder and deflection of a rod-shaped male screw can be more surely reduced by supporting a reference platform at the both ends of multiple points with good balance.

The present invention is not limited to the above each embodiment, and provides an effect to conduct a tube expansion process without reducing productivity wherein, in a tube expansion device 14 with a side regulating body positioning a heat exchanger 15 at a tube expansion position in nipping and holding condition, said side regulating body 26 may be provided at a predetermined point of a tube expansion device main body 14*a* through magnets 28, even if the left and right ends of a heat exchanger, namely the width of a heat exchanger increases or decreases in this case, a heat exchanger can be held in nipping and holding condition by easily and surely moving a side regulating body only.

Furthermore, the present invention provides an effect to prevent the reduction of productivity wherein, in the event that a side regulating body 26 is provided at a predetermined point of a tube expansion device main body 14*a* in freely attachable and detachable fashion through magnets 28, a stackable side regulating body 27 may be provided through positioning means at a side regulating body 26 in freely attachable and detachable fashion via magnets 28, and, in this case, if the thickness of a heat exchanger is increased because an insertion tube becomes in multiple columns from single column, the thickness of a side regulating body can be changed immediately corresponding to the thickness of a heat exchanger through easily and surely attaching and detaching a stackable side regulating body to or from a side regulating body.

And then, it goes without saying that shape, size, constitution, material, etc. of a receiving body, a rear surface regulating body, a side regulating body, a stackable side regulating body, each magnet and each portion comprising a tube expansion device of the present invention is freely changed in design within the intended scope of the present invention.

INDUSTRIAL APPLICABILITY

The present invention relates to a tube expansion device with a side regulating body which positions a heat exchanger to a tube expansion position in nipping and holding condition.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A tube expansion device comprising a reference platform to stop a force pressing plate at predetermined position, said force pressing plate freely reciprocating along longitudinal direction of posts provided on a base of said tube expansion device and setting protrusion length of a tube protruded from an end plate by pushing down said end plate of a heat exchanger set at said base, a receiving body placed on said base of which location is between said posts, a rear surface regulating body fixed to said receiving body for receiving a back side of said heat exchanger, and first side regulating bodies that are located at left and right ends of said heat exchanger for holding and positioning said heat exchanger at a tube expansion position, wherein said first side regulating bodies are provided with locking portions engaged with both upper edge and lower edge of said rear surface regulating body to restrict upward and downward movements of said first side regulating bodies, and further said first side regulating bodies are provided in freely attachable and detachable fashion through magnets to said rear surface regulating body.

2. The tube expansion device of claim 1, wherein a second side regulating body is provided in freely attachable and detachable fashion at said first side regulating bodies using said magnets through a positioning means.

3. The tube expansion device of claim 1, wherein said reference platform is supported at multiple points of said posts and an expanding and contracting rod or multiple points of said posts and a rod-shaped male screw, and provided in a fashion of freely reciprocating along said longitudinal direction of said posts through said rear surface regulating body being provided between said posts, one side of said reference platform being provided at said posts in a freely slidable fashion and the other side being provided at said expanding and contracting rod or said rod-shaped male screw.

4. The tube expansion device of claim 3, wherein a guide hole portion in which a guide bar provided parallel to said posts is inserted is provided at a portion of said reference platform, and thereby said reference platform is supported at multiple points of said posts, said expanding and contracting rod and said guide bar or at multiple points of said posts, said rod-shaped male screw and said guide bar in a fashion of freely reciprocating along said longitudinal direction of said posts.

5. The tube expansion device of claim 4, wherein said expanding and contracting rod or said rod-shaped male screw is located between a post and said guide bar.

6. The tube expansion device of claim 5, wherein a tube expansion device with said first side regulating bodies positioning a heat exchanger in nipping and holding condition at a tube expansion position is characterized in that said first side regulating bodies are provided in freely attachable and detachable fashion at a predetermined point of a tube expansion device main body through said magnets.

7. The tube expansion device of claim 6, wherein a second side regulating body is provided in freely attachable and detachable fashion at said first side regulating bodies using said magnets through a positioning means.

8. The tube expansion device of claim 1, wherein said first side regulating bodies are provided in freely attachable and detachable fashion through said magnets to said receiving body in which said rear surface regulating body is provided.

9. The tube expansion device of claim 1, wherein said magnets are provided on said rear surface regulating body.

10. The tube expansion device of claim 1, wherein said magnets are provided on said first side regulating body.

11. The tube expansion device of claim 1, wherein said magnets are provided on both said first side regulating body and said rear surface regulating body.

* * * * *